United States Patent [19]

Fukushima et al.

[11] Patent Number: 5,044,835

[45] Date of Patent: Sep. 3, 1991

[54] EXPANSION JOINT FOR USE IN CONSTRUCTING CONCRETE STRUCTURES

[75] Inventors: Takuo Fukushima; Hiroshi Inoue; Yasumasa Hayashida; Makio Takahashi, all of Tokyo, Japan

[73] Assignee: Asahi Denka Kogyo Kabushiki Kaisha, Tokyo, Japan

[21] Appl. No.: 454,155

[22] Filed: Dec. 21, 1989

[30] Foreign Application Priority Data

Dec. 29, 1988 [JP] Japan ..... 63-170902[U]

[51] Int. Cl.[5] ..... E04C 11/12

[52] U.S. Cl. ..... 405/287; 52/396; 404/74; 405/267

[58] Field of Search ..... 405/267, 108, 109, 284–286; 404/74; 52/393, 396, 403

[56] References Cited

U.S. PATENT DOCUMENTS

| | | | |
|---|---|---|---|
| 2,194,717 | 3/1940 | Older | 404/74 |
| 3,334,557 | 8/1967 | Fitzgibbon | 404/64 |
| 3,406,087 | 10/1968 | Potter | 404/64 |

FOREIGN PATENT DOCUMENTS 1315951 5/1973 United Kingdom .

*Primary Examiner*—Dennis L. Taylor

*Attorney, Agent, or Firm*—Frishauf, Holtz, Goodman & Woodward

[57] ABSTRACT

An expansion joint for use in constructing concrete material structures of the present invention has a plurality of sandwich type composite plates each comprising a sheet-like elastic body sandwiched by a pair of hard plates with a rib at both surfaces thereof are connected with each other through a water-swelling rubber.

16 Claims, 4 Drawing Sheets

EXPANSION JOINT FOR USE IN CONSTRUCTING CONCRETE STRUCTURES

BACKGROUND OF THE INVENTION

1. Field of the Invention

This invention relates to an expansion joint for constructing concrete structures which, when in use, is disposed between a pair of formworks, which are used when a concrete placement is performed.

2. Description of the Prior Art

In general, when a concrete structure comparatively long in the horizontal direction such as, for example, a bank protection wall, is to be constructed, the constructing portion of the concrete is slightly spaced apart (to form joints) in order to absorb expansion and contraction of the concrete.

The work for constructing such structure having an expansion joint is carried out by setting up a formwork and placing concrete in the formwork, removing the concrete from the formwork after the concrete is cured, attaching an expansible joint material such as a polyethylene foam to a surface thereof, and then setting up the next formwork and placing more concrete therein. When this method is adopted, it is naturally unavoidable that water leaks from the joint. Therefore, various methods for preventing leakage of water have been employed as collectively shown in FIGS. 2A, 2B, 2C and 2D.

That is, FIGS. 2A to 2D are partly sectional views, each schematically showing a portion of a concrete wall and more particularly a cross sectional view in its width direction. In FIGS. 2A to 2D, a joint formed at the portion between concrete bodies A and B extending in the horizontal direction is filled with a polyethylene foam 1 for filling a gap.

And in order to present leakage of water from occurring in the width direction through the joint, various methods are employed for the portion between concrete bodies A and B such as a method for embedding an extensible water stopping plate 2 (FIG. 2A) or **2*a* (FIG. 2B) extending in the vertical direction to block the joint, a method for interposing a water swelling rubber 3 (FIG. 2C), filling a elastic sealing material 4 (FIG. 2D**) to each wall surface, or a method for combining these methods.

In such conventional working method as mentioned above, concrete is removed from a formwork after the concrete is cured, a joint is formed, a water stopping plate is attached, and thereafter the next formwork is set up. Accordingly, it has the disadvantage that much time and labor are required for working, concrete cannot be placed continuously, and working time is long in general.

When reviewing the above-mentioned individual methods, the water stopping method using the water stopping plate 2 or **2*a* has such problems as that since a single water stopping plate must be placed on the first and second concrete bodies, the setting up of the formwork is very troublesome and the time required for construction is long. Moreover, regarding the water stopping, since a gap is generated between the water stopping plate 2 or 2*a*** and the concrete body A or B, leakage of water is unavoidable. Therefore, in recent years, there was developed a water stopping plate, a part of which is formed of a water swelling rubber in order to completely stop the water leakage. However, this case again is not successful in simplifying the constructing method.

In the method using the water swelling rubber 3, a water swelling rubber may be simply attached to the first placing concrete body and the constructing method is somewhat simplified. However, simple use of the water swelling rubber is not enough for expecting a complete water stop caused by the above-mentioned expansion. In order to obtain a more complete water stop, a larger water swelling rubber compared with the joint width must be used and this gives rise to another problem in respect of cost.

Furthermore, the method using the elastic sealing material 4 has such problems as that the attaching surface is easily peeled caused by repeated expansion and contraction and durability, and therefore leakage of water is unavoidable.

SUMMARY OF THE INVENTION

The object of the present invention is to provide an expansion joint for use in constructing concrete material structures which is simple in conducting construction work and in which time required for construction work can be shortened and a complete water stopping property can be imparted to the joint.

In order to achieve the above object, in recent years, there was developed a structure for an expansion joint. This structure also served as a formwork and comprises, as shown in FIG. 3, formworks 6 and **6*a* disposed between and perpendicular to a separator 5 and extending in the horizontal direction, a polyethylene foam 1 disposed vertical to the formworks 6 and 6*a*, and reinforcement plates 7 and 7*a* attached to both sides of the polyethylene foam 1 in a sandwich fashion. This structure for an expansion joint was developed in order to shorten the time required for the construction work. However, even by this method, a satisfactory water stopping property is unobtainable because the water stopping is performed only by a sealing member 4** on the side of a wall surface.

The present invention has successfully solved the above problems and has achieved the above object by providing an expansion joint for use in constructing concrete structures characterized in that a plurality of sandwich type composite plates each comprising a sheet-like elastic body sandwiched by a pair of hard plates with a rib at both sides thereof are connected with each other through a water swelling rubber.

According to the present invention, the expansion joint for use in constructing concrete structures can be set to a side formwork with ease and in a simple manner by inserting the formwork separator into the rib. When the formwork is removed after the concrete is in place, a concrete structure having the joint comprising the expansion joint for use in constructing concrete structures is accomplished. At the same time, the water invading into this joint contacts the water swelling rubber of the expansion joint for use in constructing concrete material structures. As a result, the water swelling rubber is swollen to fill the gap. Therefore, the above-mentioned joint can result in complete water stoppage.

DETAILED DESCRIPTION OF THE INVENTION

The present invention will be described in detail hereunder with reference to the embodiments.

Figure 1:
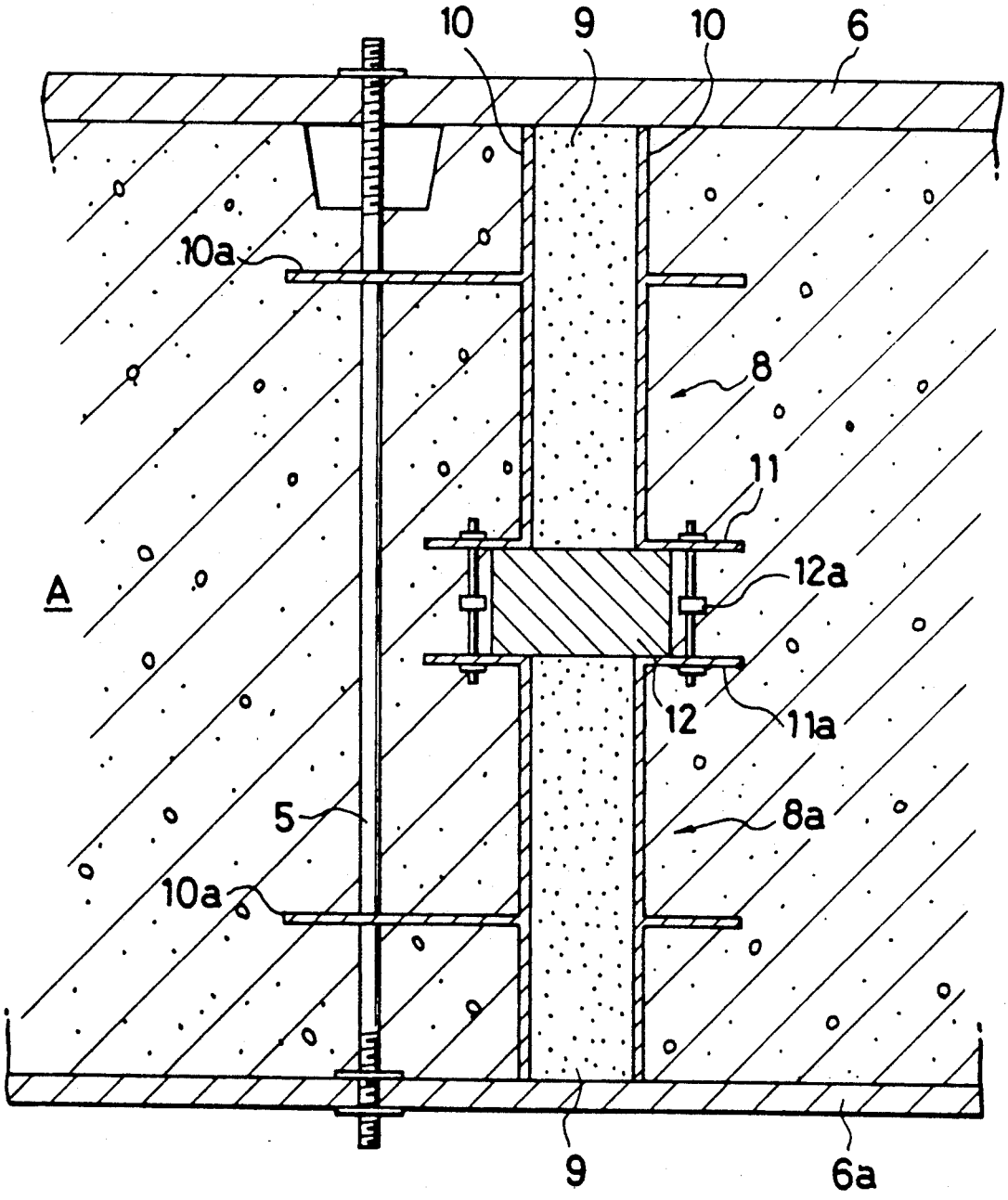
FIG. 1 is a partly sectional view schematically showing an expansion joint for use in constructing concrete structures of the present invention and its mode of use.
Figure 2A:
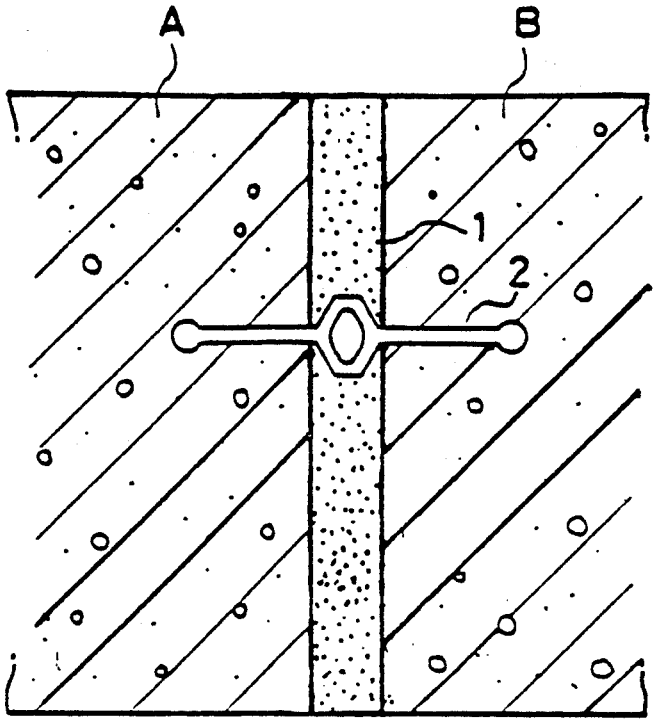
FIG. 2A (PRIOR ART)
FIGS. 2A, 2B, 2C and 2D are partly sectional views, each schematically showing the joint of a conventional concrete structure.
Figure 2B:
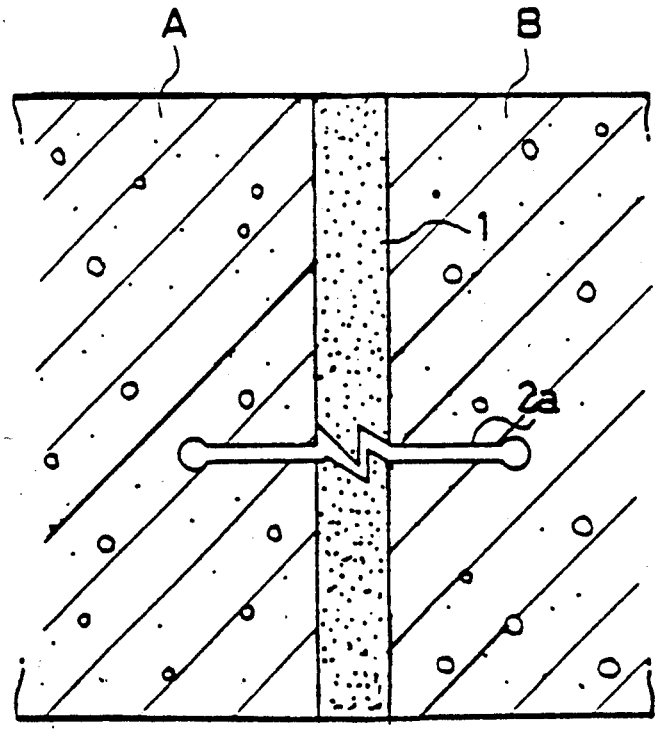
FIG. 2B (PRIOR ART)
Figure 2C:
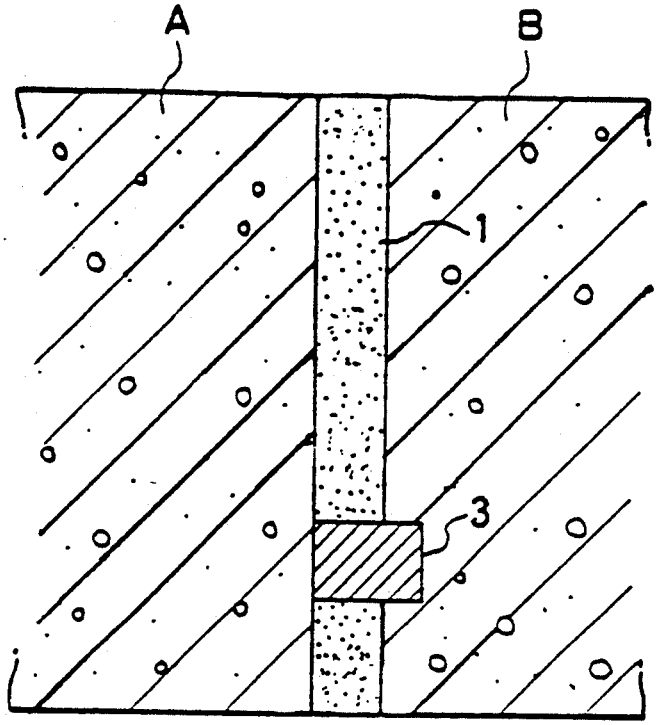
FIG. 2C (PRIOR ART)
Figure 2D:
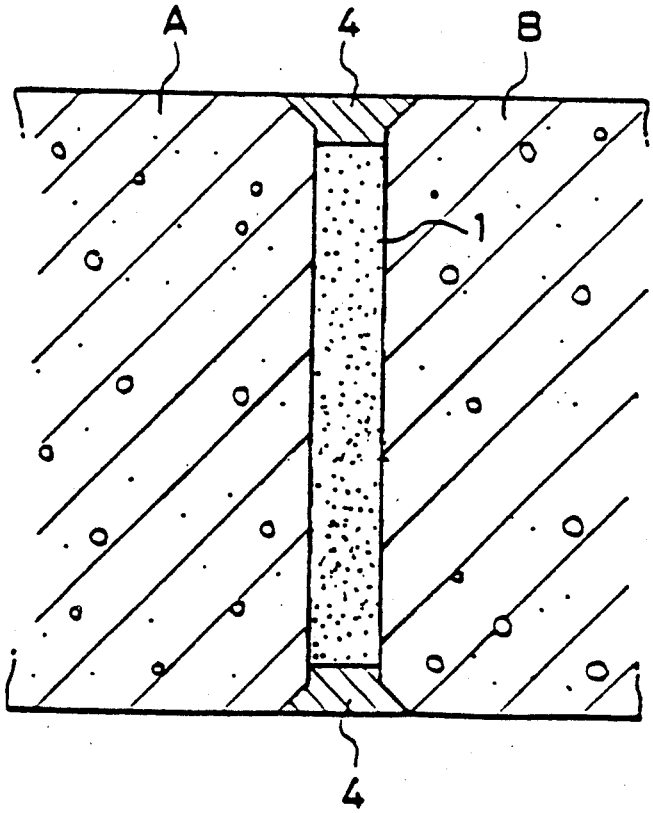
FIG. 2D (PRIOR ART)
Figure 3:
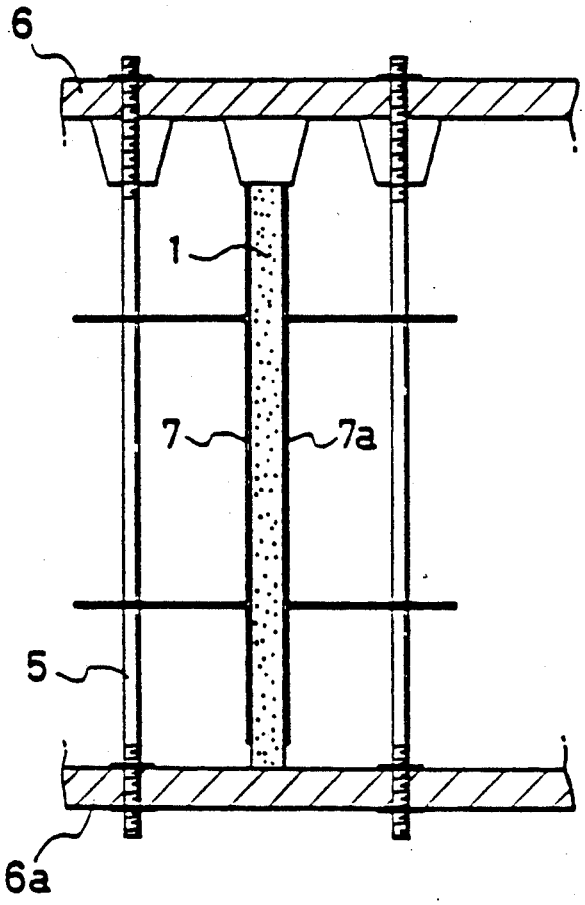
FIG. 3 is a partly sectional view schematically showing a recent formwork material for an expansion joint and its mode of use.

FIG. 1 is a partly sectional view schematically showing an expansion joint for use in constructing concrete structures according to one embodiment of the present invention and its mode of use.

The formwork material of this embodiment is disposed between and perpendicular to two formworks 6 and 6*a* spaced apart by a separator 5 as such that the formwork 6 is located in an upper position and the other formwork 6*a* is located in a lower position in the drawing and extending in the horizontal direction. The formwork material of this embodiment comprises two sandwich type composite plates 8 and 8*a* connected with each other.

Each of the composite plates 8 and 8*a* comprises a sheet-like elastic body 9 sandwiched by a pair of hard plates 10 with a rib at both sides thereof. The two members, elastic body 9 and hard plates 10, are integral with each other. Each of the hard plates 10 is provided with a plurality of ribs 11, 11*a*, 10*a* disposed perpendicular thereto. By tightening the ribs 11 and 11*a* located at proximate ends of the two composite plates 8 and 8*a*, a water swelling rubber 12 interposed between the ribs 11 and 11*a* is pressed to be fixed and at the same time the composite plates 8 and 8*a* are interconnected in the vertical direction in the drawing. In other words, the water swelling rubber 12 constitutes an interconnecting portion for the sandwich type composite plates 8 and 8*a*.

Also, the formwork material is disposed between the formwork 6 and 6*a* with ease and without fail by having the separator 5 penetrate the ribs 10 which the composite plates 8 and 8*a* constituting the formwork material have.

According to the present invention, concrete is gradually placed between the formworks 6 and 6*a* partitioned by the composite plates 8 and 8*a* to form the concrete body A. Finally, the concrete body A can form a continuous concrete wall (not shown) through the formwork material.

Accordingly, by using the formwork material, a concrete structure having the formwork material at the joint portion is accomplished. And in this structure, a stress caused by expansion and contraction of the body at each side of the formwork material can be absorbed by the sheet-like elastic body. At the same time, invasion of water into the direction of the joint surface can be prevented by the water swelling rubber 12 without fail.

Next, the expansion joint for use in constructing concrete structures of this embodiment will be described in more detail. The sheet-like elastic body has a compression-proof load property enough to easily follow the expansion and contraction of the concrete and not to be deformed by pressure of the concrete.

Examples of the above-mentioned elastic body include various foams such as polyethylene foam, polystyrene foam, rubber sponge, polyurethane foam and polyvinyl chloride foam. Among these foams, polyethylene foam is particularly preferable. It is preferable that said foam is impermeable to water. Further, a foam having a high content of closed cells and a foam impregnated with, for example, asphalt or tar so as to elevate the water repellency thereof may be preferably used therefor.

As the above-metioned ribbed rigid board, rigid plastic boards excellent in durability and corrosion resistance, for example, polyvinyl chloride, polyethylene, polypropylene and FRP boards may be suitably employed.

Further, it is important for said water-swelling rubber 12 to be wider than the joint. A water-swelling rubber which is particularly preferable in the present invention may be obtained by kneading the following urethane prepolymer (1) together with the following rubber (2).

(1) Urethane prepolymer:

A terminal isocyanate group-containing urethane prepolymer which is obtained by reacting one or more polyether polyols represented by the general formula:

$$R[(OR')_n]_p$$

wherein

R represents a polyhydric alcohol residue, (OR') represents a polyoxyalkylene chain comprising oxyethylene groups and an alkylene group carrying three or four carbon atoms, provided that the content of the oxyethylene groups amounts to 20 to 100% of the total molecular weight, n is a number corresponding to the degree of polymerization of the oxyalkene groups and giving a hydroxyl group equivalent of 200 to 2500, and p is a number of 2 to 8, preferably 2 to 4, with a polyisocyanate, optionally together with a crosslinking agent.

(2) Rubber:

A rubber selected from the group consisting of natural rubbers, synthetic rubbers, reclaimed rubbers and mixtures thereof.

In order to prepare the above-mentioned water-swelling rubber, it is preferable to blend 10 to 150 parts of said urethane prepolymer with 100 parts by weight of said rubber.

Examples of said polyhydric alcohol employed to obtained polyether polyol represented by the above-mentioned formula include dihydric alcohols such as ethylene glycol and propylene glycol; trihydric alcohols such as glycerol and trimethylolpropane; tetrahydric alcohols such as erythritol and pentaerythritol; pentahydric alcohols such as arabitol and xylitol; and hexahydric alcohols such as sorbitol and mannitol.

Said polyether polyols may be obtained by adding alkylene oxide(s) to these polyhydric alcohols in such a manner as to give the desired molecular weight. Either random or block addition may be employed therefor. When the content of the oxyethylene groups is less than 20%, the resulting material is unsatisfactory as a water-stop material. Any polyisocyanates may be employed. The content of the terminal isocyanate groups may be 1 to 12%, preferably 2 to 7%.

Examples of said crosslinking agent include polyols and polyamines each carrying two to six active hydrogen atoms per molecule and has an average molecular weight per active hydrogen atom of 30 to 15000, for example, low-molecular weight polyols, addition polymers of low-molecular weight polyols and alkylene oxides and addition polymers of low-molecular weight polyamines and alkylene oxides, as well as mixtures thereof.

As described previously, the rib 11 on the end portion of the sandwich type composite plate 8 is integrally connected to the hard plate rib 11*a* of the other sandwich type composite plate 8*a* by bolt means. In this case, if a water swelling rubber ring-like water stopping material 12*a* is attached to the bolt as shown in the drawing, the water stopping property is much improved and thus preferable.

Although the present invention has been described in detail, the expansion joint for use in constructing concrete structures of the present invention is not limited to the above embodiment. It goes without saying that various changes and modifications can be made without departing from the spirit of the invention.

The formwork material of the present invention can be fixed between the formwork with ease by having the separator penetrate reinforcement plates (hard plates) such as, for example, ribs. Accordingly, it can exhibit an excellent function as an expansion joint for use in constructing concrete structures with ease and without fail. By virtue of the provision of the reinforcement plate and the separator, there is a sufficient resistance against concrete pressure when concrete placement is performed. Accordingly, the formwork material can be prevented from being warped and concrete placement can be performed at any side of the formwork material or at both sides simultaneously. As a result, the time required for construction work can be greatly reduced.

Furthermore, by simply removing the formworks after the concrete is cured, there can be obtained a concrete structure having an expansible joint. And the intermediate water swelling rubber in the formwork material constituting the expansible joint can be fixed merely by an adhesive force and by tightening a bolt. Accordingly, it can easily follow the expansion and contraction of the concrete body and sufficiently exhibit the effect of the expansion joint.

Therefore, water invading between the concrete body and the reinforcement plate, and between the joint material and the reinforcement plate can be completely stopped because the intermediate water swelling rubber is swollen when it contacts the water.

What is claimed is:

1. An expansion joint for use in constructing concrete structures, the expansion joint comprising a plurality of sandwich type composite plates, each composite plate comprising a sheet-like elastic body sandwiched between a pair of hard plates with a rib at an end of each of said hard plates, said ribs being connected to each other by a connection means and a water-swelling rubber disposed between said composite plates.

2. The expansion joint as set forth in claim 1, wherein said water-swelling rubber is a mixture obtained by kneading a urethane prepolymer together with a rubber, said urethane prepolymer is a terminal isocyanate group-containing urethane prepolymer which is obtained by reacting one or more polyether polyols represented by the formula:

$$R((OR')_n)_p$$

wherein

R represents a polyhydric alcohol residue, (OR') represents a polyoxyalkylene chain comprising oxyethylene groups and an alkylene group carrying three or four carbon atoms, provided that the content of the oxyethylene groups amounts to 20 to 100% of the total molecular weight, n is a number corresponding to the degree of polymerization of the oxyalkene groups and having a hydroxyl group equivalent of 200 to 2500, and p is a number of 2 to 8, with a polyisocyanate, optionally together with a crosslinking agent.

3. The expansion joint as set forth in claim 2, wherein said rubber is selected from the group consisting of natural rubbers, synthetic rubbers, reclaimed rubbers and mixtures thereof.

4. The expansion joint as set forth in claim 2, wherein said urethane prepolymer and said rubber are blended at a ratio of 10 to 150 parts by weight of said urethane prepolymer based on 100 parts by weight of said rubber.

5. The expansion joint as set forth in claim 1, wherein the sheet-like elastic body is selected from the group consisting of polyethylene foam, polystyrene foam, rubber sponge, polyurethane foam and polyvinyl chloride foam.

6. The expansion joint as set forth in claim 4, wherein the sheet-like elastic body is polyethylene foam.

7. The expansion joint as set forth in claim 4, wherein the sheet-like elastic body is a foam impregnated with asphalt or tar.

8. The expansion joint as set forth in claim 6, wherein the polyhydric alcohol is selected from the group consisting of a dihydric alcohol, a trihydric alcohol, a tetrahydric alcohol, a pentahydric alcohol and a hexahydric alcohol.

9. The expansion joint as set forth in claim 6, wherein the polyhydric alcohol is selected from the group consisting of ethylene glycol, propylene glycol, glycerol, trimethylolpropane, erythritol, xylitol, sorbitol and mannitol.

10. The expansion joint as set forth in claim 2, wherein p is 2 to 4,.

11. The expansion joint as set forth in claim 8, wherein the terminal isocyanate groups are in an amount of 1 to 12%.

12. The expansion joint as set forth in claim 8, wherein the terminal isocyanate groups are in an amount of 2 to 7%.

13. The expansion joint for constructing concrete formwork as set forth in claim 11, wherein the cross-linking agent is selected from group consisting of polyols and polyamides, said cross-linking agent carrying two to six active hydrogen atoms per molecule and having an average molecular weight per active hydrogen atom of 30 to 15,000.

14. The expansion joint as set forth in claim 13, wherein the cross-linking agent is selected from the group consisting of addition polymers of low- molecular weight polyols and alkylene oxides; addition polymers of low-molecular weight polyamines and alkylene oxides; low-molecular weight polyols and mixtures thereof.

15. The expansion joint as set forth in claim 1, wherein the ribs are disposed perpendicular to the hard plates the connection means are bolt means.

16. The expansion joint as set forth in claim 14, wherein the ribs are disposed perpendicular to the hard plates and the connection means are bolt means.

* * * * *